United States Patent [19]

Danieli et al.

[11] 3,986,870

[45] Oct. 19, 1976

[54] METHOD OF MANUFACTURING BODIES BY PRESSURE SINTERING OF POWDER

[75] Inventors: Sten Henrik Danieli; Nils Ivar Landgren; Arne Sundstrand, all of Vasteras, Sweden

[73] Assignee: Allmanna Svenska Elektriska Aktiebolaget, Vasteras, Sweden

[22] Filed: Dec. 3, 1973

[21] Appl. No.: 420,923

[30] Foreign Application Priority Data

Dec. 4, 1972 Sweden ..... 15742/72

[52] U.S. Cl. ..... 75/211; 75/225; 75/226; 53/9

[51] Int. Cl.[2] ..... B22F 3/00; B65B 31/06; B22F 3/12

[58] Field of Search ..... 75/226, 211, 225; 141/65; 53/7, 9

[56] References Cited

UNITED STATES PATENTS

| | | | |
|---|---|---|---|
| 3,342,009 | 9/1967 | Anderson | 53/22 |
| 3,353,325 | 11/1967 | Jensen et al. | 53/22 A |
| 3,474,516 | 10/1969 | Finlay et al. | 75/226 |
| 3,599,281 | 8/1971 | Boyer | 75/214 |
| 3,728,111 | 4/1973 | Stromblad et al. | 75/226 |

*Primary Examiner*—Brooks H. Hunt

[57] ABSTRACT

In manufacturing products by enclosing a body of powder in a capsule and compacting it into a solid body by subjecting it to high temperature and high all-sided pressure, a capsule is used which has a connection sleeve in one wall with a through opening for connection of a capsule to the vacuum pump. An arrangement is provided for exerting an external outward pressure on this sleeve, so as to lift the wall away from the surface of the powder within the container, so that a large surface area is provided to permit easier release of gases when the capsule is subjected to vacuum. Thereafter, a plug is inserted in the opening of the connection sleeve, so as to seal the opening.

1 Claim, 3 Drawing Figures

METHOD OF MANUFACTURING BODIES BY PRESSURE SINTERING OF POWDER

BACKGROUND OF THE INVENTION

1. Field of the Invention

The present invention relates to a method of manufacturing products by forming and enclosing a body of powder in a casing and binding together and compacting the powder into a solid body by subjecting it to high temperature and a high all-sided pressure. A casing with an enclosed powder body is evacuated prior to and/or during the heating so that the powder body is degassed and, in this way, the substances which are harmful to the material are removed. The invention is of particular interest for the degassing operation in the manufacture of large billets of material of such a composition that manufacture by conventional casting methods gives unsatisfactory results, for example coarse structure or segregations. The method is particularly advantageous in the manufacture of billets of material of high-speed steel type or of superalloys for further machining to the desired shape by means of rolling, forging or machining.

2. The Prior Art

To construct an evacuation connection which results in a great surface for the escape of gas on the powder body but which simultaneously withstands the subsequent hot pressing, has proved to involve very great difficulties.

During the heating, the material in the capsule, the vacuum connection and particularly the joining welds and the material of adjoining parts change their properties and leaks occur when the capsule is deformed in the hot pressing. The difficulties have increased with increased capsule volume and with increased heating and heat retaining time prior to the hot-pressing. An increase in the capsule volume automatically involves an increase in the heating time and thus an increased risk of changes in the material which may give rise to leaks in the capsule when it is deformed during hot pressing. In one case, a funnel-shaped vacuum connection with an internal conical support body has been used to reduce the stresses. By means of that arrangement, the stresses in and at the joing between the capsule wall and the vacuum connection are reduced, and simultaneously a large powder body-surface liberating gases is obtained around the vacuum connection.

SUMMARY OF THE INVENTION

According to the invention, a capsule is provided with a connection sleeve with a through opening in one relatively flexible wall. An arrangement is provided which exerts an upward, outward pressure on the connection sleeve, thus lifting the wall away from the surface of the powder. The capsule is then evacuated, the increased area of the free surface of the powder expediting the removal of the gas from within the powder. A plug is then inserted in the through opening, and the sealed capsule is subjected to heat and pressure.

BRIEF DESCRIPTION OF THE DRAWINGS

The invention is further described with reference to the accompanying drawings.

DESCRIPTION OF THE PREFERRED EMBODIMENTS

Figure 1:
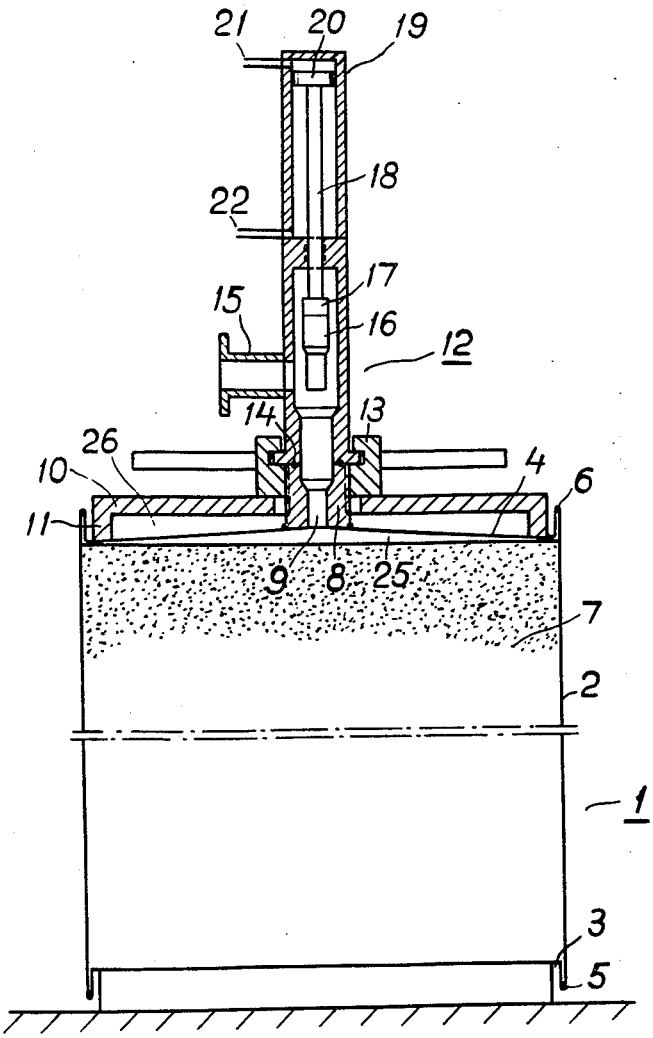
FIG. 1 shows in section a cylindrical capsule and a unit placed thereon for connecting the capsule to a suction line.

In the Figures, 1 designates a capsule constructed of a cylinder 2, a bottom 3 and a lid 4 which are joined by welds 5 and 6. The capsule is filled with a packed powder 7. At the center of the lid 4 is an outwardly threaded connection sleeve 8 with a through opening 9. On the lid a plate 10 with a flange 11 rests. A connection unit 12 for connecting the capsule and a vacuum line is connected to the sleeve 8 by a nut 13. Sealing is achieved by means of a washer 14. The unit 12 is provided with a tube 15 by which it is connected to a suction line. In the unit 12 there is a sealing plug 16 for sealing the opening 9 in the sleeve 8 after evacuation of the capsule. The plug 16 is suspended in the holder 17 at the end of the piston rod 18, for example by a magnet. The unit 12 is shaped at its upper part as a cylinder 19, in which the piston 20 runs. The cylinder 19 is connected to a pressure medium source by way of lines 21 and 22 and valve devices (not shown).

Figure 2:
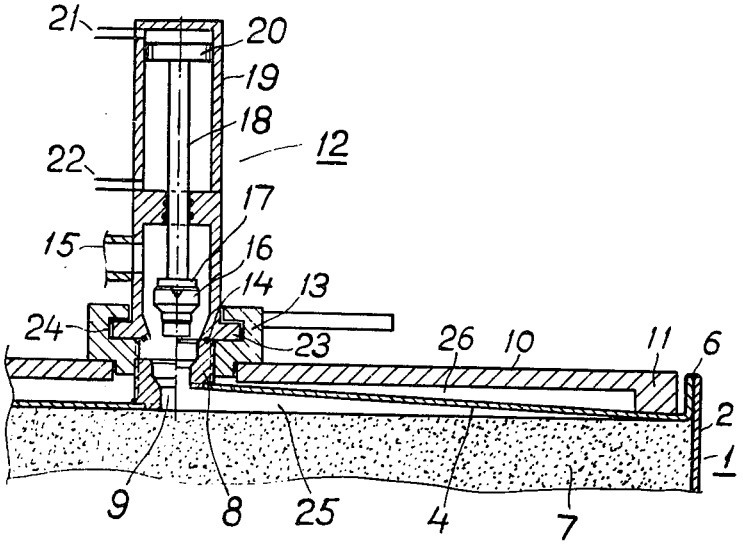
FIG. 2 shows the same equipment on a larger scale.

When the capsule 1 is to be connected to a suction pipe (not shown), the plate 10 with the flange 11 is positioned against the lid 4 of the capsule and the nut 13 is screwed onto the threaded sleeve 8, the sleeve 8 being drawn upwards until it makes contact with the lower side of the flange 23 of the connection unit 12. As is clear from the figures, the flange 23 runs in a slot 24 in the nut 13. Sealing is achieved by means of the washer 14. When the sleeve is drawn upwards from the position shown in the left-hand part of FIG. 2 to the position shown in the right-hand part of the same Figure, an annular gap 25 is obtained between the lid 4 and the powder 7 so that a large surface is exposed, from which gas in the powder may escape freely. In some cases it may be desirable to maintain a pressure below the atmospheric pressure in the space 26 so that depression of the lid 4 owing to the low pressure on its underside is prevented. It is also possible to mount a number of drawing members on the lid 4, which prevent depression of the lid owing to the low pressure in the capsule.

The plug 6 is provided with an enlarged head, and the upper end of the through passage 9 is also provided with an enlarged portion, into which the enlarged head of the plug fits, so that when the plug is engaged it cannot be drawn by the vacuum within the capsule down into the capsule.

After the evacuation is completed, the pipe 21 is supplied with fluid under pressure, and the piston 20 drives the plug 16 into the through opening 9, after which the fluid is supplied to pipe 21, driving piston 20 downwards and seating the plug in the through opening. Then the magnet is deenergized and the plug remains in the hole where it is held by the vacuum in the capsule.

Figure 3:
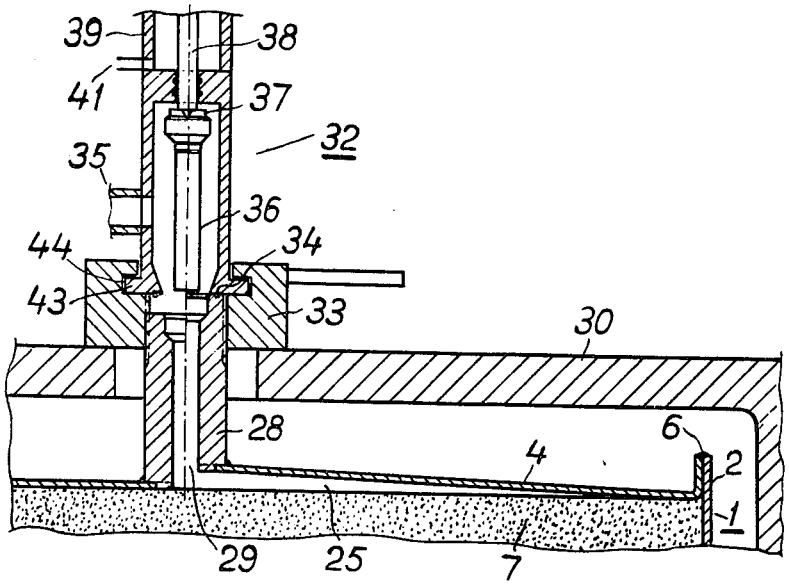
FIG. 3 shows the corresponding equipment for connecting the capsule to a suction line when the capsule is placed in a heating furnace.

If the capulse is evacuated during the heating and the capsule is placed in a furnace as shown in FIG. 3, the furnace lid 30 can be used as a force-absorbing member and the nut 33 of the connection unit 32 can be allowed to rest on the lid 30. The nut is suitably water-cooled. The connection sleeve 28 may have such a length, as shown in the figure, that it projects through the lid 30 or the nut 33 may project down through the furnace. Sealing is achieved as previously by a washer 34 and the unit 32 is provided with a connection tube 35. In the unit 32 is a sealing plug 36, adapted to fit the lower connection sleeve 28, to seal the opening 29 after evacuation. The plug is in this case suspended in a holder 37 at the end of the piston rod 38. This rod is connected to a piston in the cylinder 39, which is connected to a pressure medium source through the lines 41 and a line (not shown). The flange 43 of the connection unit 32 runs in an annular slot 44 in the center of the nut 33.

We claim:

1. In a method of manufacturing products by forming and enclosing a body of powder in a capsule and binding together and compacting the powder into a solid body by subjecting it to high temperature and a high all-sided pressure, a wall of the capsule being provided with a connection sleeve with a through opening for connection of the capsule to a vacuum pump, which comprises subjecting said wall to external tensile force of such a magnitude that a gap is formed between the wall and the powder enclosed in the capsule, evacuating the capsule, after which inserting a sealing plug into the through opening of the connection sleeve, and thereafter hot pressing the capsule with its contents in a pressure furnace.

* * * * *